US007864206B2

(12) United States Patent
Yasumatsu

(10) Patent No.: US 7,864,206 B2
(45) Date of Patent: Jan. 4, 2011

(54) THERMAL TRANSFER LAMINATE FILM, THERMAL TRANSFER SHEET, AND IMAGE-FORMING APPARATUS

(75) Inventor: Ryo Yasumatsu, Kanagawa (JP)

(73) Assignee: Sony Corporation, Tokyo (JP)

( * ) Notice: Subject to any disclaimer, the term of this patent is extended or adjusted under 35 U.S.C. 154(b) by 45 days.

(21) Appl. No.: 12/476,708

(22) Filed: Jun. 2, 2009

(65) Prior Publication Data

US 2009/0303307 A1 Dec. 10, 2009

(30) Foreign Application Priority Data

Jun. 5, 2008 (JP) ..... 2008-147953

(51) Int. Cl.
*B41J 2/325* (2006.01)

(52) U.S. Cl. ..... 347/217

(58) Field of Classification Search ..... 347/217, 347/171, 172, 174, 176; 400/120.01, 237
See application file for complete search history.

(56) References Cited

U.S. PATENT DOCUMENTS 5,851,720 A * 12/1998 Shinohara ..... 430/201

FOREIGN PATENT DOCUMENTS

| | | |
|---|---|---|
| JP | 59-076298 | 5/1984 |
| JP | 59-085973 | 5/1984 |
| JP | 60-204397 | 10/1985 |
| JP | 63-209993 | 8/1988 |
| JP | 2001-162937 | 6/2001 |
| JP | 2005-125747 | 5/2005 |
| JP | 2007-160768 | 6/2007 |

* cited by examiner

*Primary Examiner*—Huan H Tran
(74) *Attorney, Agent, or Firm*—SNR Denton US LLP

(57) ABSTRACT

A thermal transfer laminate film includes a base film, a non-transferable release layer made of a rubber-elastic resin and disposed on one side of the base film, and an image-protecting layer disposed on the non-transferable release layer.

8 Claims, 4 Drawing Sheets

THERMAL TRANSFER LAMINATE FILM, THERMAL TRANSFER SHEET, AND IMAGE-FORMING APPARATUS

BACKGROUND OF THE INVENTION

1. Field of the Invention

The present invention relates to a thermal transfer laminate film, a thermal transfer sheet, and image-forming apparatus.

2. Description of the Related Art

In general, an image formed on photographic paper, such as an ink image formed by a sublimation dye transfer printing method using sublimation dye or thermal diffusion dye is coated with an image-protecting layer made of a thermoplastic resin to protect the ink image.

The coating of the image-protecting layer can be formed over the ink image by thermocompression using a heat roller, or by adhesion using an adhesive at room temperature.

For example, an image-laminating film is used. The image-laminating film includes a base film and an image-protecting layer formed of a thermoplastic resin on the base film. In use of the image-laminating film, the image-protecting layer of the image-laminating film is partially heated and pressed, so that only the image-protecting layer is transferred onto photographic paper. In this technique, a thermal transfer laminate film may be used (for example, Japanese Unexamined Patent Application Publication Nos. 59-76298, 59-85973, and 60-204397).

By use of a thermal transfer laminate film, images can be protected from gases that may degrade the images. A UV light-absorbable thermal transfer laminate film can prevent images from discoloring or fading. Also, the ink forming images is prevented from being transferred to other materials or articles containing a plasticizer, such as a plastic eraser. As described above, the use of a thermal transfer laminate film can provide various properties, such as plasticizer resistance, rubfastness and sebum resistance, to printed images.

Printed matter produced by coating an ink image with an image-protecting layer is used not only as merely image-printed matter, but also as an alternative to a silver halide photograph, such as an identification photograph.

In the thermal transfer method, only the image-protecting layer of a thermal transfer laminate film including a base film and a thermoplastic resin image-protecting layer is partially heated and pressed, so that only the heated image-protecting layer is transferred onto photographic paper. Accordingly, the materials of the thermal transfer laminate film are designed mainly so that the image-protecting layer and the base film can easily be separated. Value-adding properties or functions of printed matter, such as glossiness, have not yet been controlled.

A thermal transfer head has a structure in which heaters are continuously aligned in the principal scanning direction. The temperature of the heaters rises to 300° C. or more for printing. When thermal energy is transmitted in the thickness direction of the ink ribbon (particularly the thermal transfer laminate film) from the thermal transfer head, the layers of the thermal transfer laminate film and the receiving layer of the photographic paper have a temperature distribution according to the arrangement of the heaters of the thermal transfer head. The thermal transfer laminate film include a heat-resistant slip layer, the base film, an adhesion promoting layer or primer layer (optionally), a non-transferable release layer, the image-protecting layer, and an adhesive layer. When the resin materials of these layers come to a molten state, the same temperature distribution arises.

Consequently, the ink ribbon is cooled from a high temperature of 300° C. or more after scanning the thermal transfer head. Since the base film of the ink ribbon is thermally deformed (shrunk) during cooling, the interface between the non-transferable release layer and the image-protecting layer is also deformed concurrently. Consequently, the ink ribbon is peeled at the interface between the non-transferable release layer and the image-protecting layer to make the surface of the image-protecting layer rough and expose the rough surface. Light incident on such a rough surface of printed matter is scattered to degrade the glossiness of the surface of the printed matter undesirably.

In order to solve the problem that the rough surface of the image-protecting layer of printed matter causes light scattering to degrade the glossiness, the following measures have been taken.

One of the measures is that a secondary pressure is applied to printed matter whose ink is coated with an image-protecting layer thermally transferred from a thermal transfer laminate film by a roller having a smooth surface of 25 μm or less in surface roughness, thus giving glossiness to the surface of the printed matter (for example, Japanese Unexamined Patent Application Publication No. 63-209993).

In another measure, a pressuring surface is provided to the downstream side of the heaters of the thermal transfer head, and a smooth surface is formed by pressurization with the flat pressuring surface (for example, Japanese Unexamined Patent Application Publication No. 2005-125747).

These two measures enhance the glossiness by surface treatment of the printed matter.

A polyester film is proposed for a sublimation dye transfer ribbon (for example, Japanese Unexamined Patent Application Publication No. 2007-160768). This film maintains the anisotropy of glossiness at the surface of the image-protecting layer after transfer and also maintains high glossiness.

The above cited measures however apply secondary treatment to the printed matter, and accordingly, the system of the sublimation-type printer becomes excessively large. In addition, for example, extra materials are used for the secondary treatment. Thus, these measures are disadvantageous in cost. Furthermore, a glossiness at the same level as silver halide photographs is not sufficiently obtained only by smoothing the base film.

In another measure, a cushion layer is provided between the support and the thermal transfer layer of a thermal transfer material (for example, Japanese Unexamined Patent Application Publication No. 2001-162937). When an image is formed with a metallic glossy coloring material having a single hue, the cushion layer is used to bury the particles of the metallic glossy coloring material.

SUMMARY OF THE INVENTION

The problem to be solved is that secondary treatment is performed because the same glossiness as silver halide photographs may not be obtained only by smoothing the base film.

The present invention makes it possible to achieve the same glossiness as silver halide photographs and to provide printed matter having a glossiness and surface smoothness appealing to the sensibility of the user without applying secondary treatment.

Accordingly, a thermal transfer laminate film according to an embodiment of the invention includes a base film, a non-transferable release layer made of a rubber-elastic resin and disposed on one side of the base film, and an image-protecting layer disposed on the non-transferable release layer.

The thermal transfer laminate film is cooled from a high temperature of 300° C. or more after scanning a thermal transfer head. The base film of the thermal transfer laminate film is thermally deformed (shrunk) during cooling. Roughness resulting from the deformation of the base film spreads from the surface on which the thermal transfer head has been pressed toward the opposite side (image-protecting layer side). Since the non-transferable release layer is made of a rubber-elastic resin, however, the deformation of the base film is absorbed at the surface on the base film side of the non-transferable release layer, and does not spread to the surface on the image-protecting layer side of the non-transferable release layer.

A rubber-elastic material is a highly viscous liquid in a sense. Accordingly, a small deformation as in the base film (by, for example, pressure or heat) is absorbed at the surface of the rubber-elastic material. Then, on removing the external force of the base film, the original form of the rubber-elastic material is momentarily recovered.

Since the non-transferable release layer is made of a rubber-elastic resin, the deformation of the non-transferable release layer side of the base film is absorbed by elastic deformation of the surface on the base film side of the non-transferable release layer, and does not spread to the image-protecting layer side of the non-transferable release layer. Thus, even if the base film is thermally deformed (shrunk) to have a rough surface after scanning with the thermal transfer head pressed on the base film, the peeled surface of the image-protecting layer is kept smooth.

A thermal transfer sheet according to an embodiment of the invention includes a base film, a non-transferable release layer made of a rubber-elastic resin and disposed on a first surface side being one side of the base film, an image-protecting layer disposed on the non-transferable release layer, and an ink layer disposed on the first surface side. The ink layer is to be thermally transferred to form an image.

The base film of the thermal transfer sheet is pressed by a thermal transfer head. Even if the base film is thermally deformed (shrunk) to have a rough surface after scanning, the roughness at the surface of the base film is absorbed by the surface on the base film side of the non-transferable release layer. Consequently, the roughness at the surface of the base film does not spread to the surface on the image-protecting layer side of the non-transferable release layer.

Since the non-transferable release layer is made of a rubber-elastic resin, the deformation of the non-transferable release layer side of the base film is absorbed by rubber-elastic deformation of the surface on the base film side of the non-transferable release layer, and does not spread to the image-protecting layer side. Thus, even if the base film is thermally deformed (shrunk) to have a rough surface after scanning with the thermal transfer head pressed on the base film, the peeled surface of the image-protecting layer is kept smooth.

An image-forming apparatus according to an embodiment of the invention includes: transporting means for transporting a recording medium in a predetermined direction; a thermal transfer sheet including an ink layer being to be transferred onto the surface of the recording medium to form an image and an image-protecting layer being to be transferred to protect the image; thermal transfer sheet-transporting means for transporting the thermal transfer sheet; and a thermal transfer head transferring the ink layer or the image-protecting layer of the thermal transfer sheet onto the surface of the recording medium. The image-protecting layer is disposed on a non-transferable release layer made of a rubber-elastic resin disposed on one side of the base film of the thermal transfer sheet.

The image-forming apparatus uses the thermal transfer sheet according to an embodiment of the invention. The thermal transfer head is pressed on the base film side. Even if the base film is thermally deformed (shrunk) to have a rough surface after scanning, the roughness at the surface of the base film is absorbed by the elastic deformation of the surface on the base film side of the non-transferable release layer. Consequently, the roughness at the surface of the base film does not spread to the surface on the image-protecting layer side of the non-transferable release layer.

Since the non-transferable release layer is made of a rubber-elastic resin, the deformation of the non-transferable release layer side of the base film is absorbed by rubber-elastic deformation of the surface on the base film side of the non-transferable release layer, and does not spread to the image-protecting layer side. Thus, even if the base film is thermally deformed (shrunk) to have a rough surface after scanning with the thermal transfer head pressed on the base film, the peeled surface of the image-protecting layer is kept smooth.

The thermal transfer laminate film allows the peeled surface of the image-protecting layer to keep smooth even if the base film is deformed (for example, by pressure or heat) Hence, the surface of the image-protecting layer transferred onto printed matter has glossiness as high as silver halide photographs have without applying secondary treatment, and the resulting printed matter has a glossiness and surface smoothness appealing to the sensibility of the user.

The thermal transfer sheet allows the peeled surface of the image-protecting layer to keep smooth even if the base film is deformed (for example, by pressure or heat). Hence, the surface of the image-protecting layer transferred onto printed matter has glossiness as high as silver halide photographs have without applying secondary treatment, and the resulting printed matter has a glossiness and surface smoothness appealing to the sensibility of the user.

The image-forming apparatus allows the peeled surface of the image-protecting layer to keep smooth even if the base film is deformed (for example, by pressure or heat). Hence, the surface of the image-protecting layer transferred onto printed matter has glossiness as high as silver halide photographs have without applying secondary treatment, and the resulting printed matter has a glossiness and surface smoothness appealing to the sensibility of the user.

DESCRIPTION OF THE PREFERRED EMBODIMENTS

A thermal transfer laminate film according to an embodiment of the invention will now be described with reference to a fragmentary sectional view taken in the thickness direction shown in FIG. 1.

Figure 1:
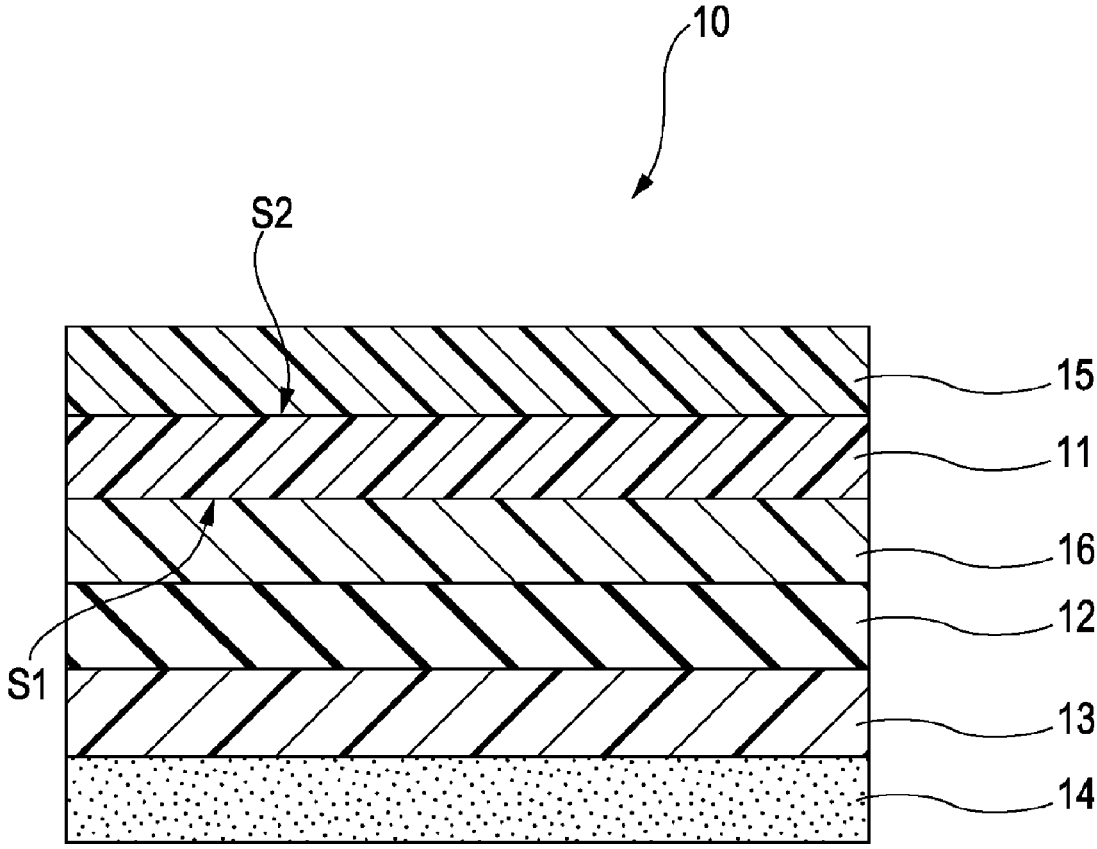
FIG. 1 is a fragmentary sectional view taken in the thickness direction of a thermal transfer laminate film according to an embodiment of the invention.

As shown in FIG. 1, the thermal transfer laminate film 10 has an image-protecting layer 13 disposed on a first surface side or on one side of a base film 11 with a non-transferable release layer 12 therebetween. The image-protecting layer 13 is formed so as to be peeled easily from the non-transferable release layer 12.

An adhesive layer is formed on the image-protecting layer 13 to facilitate the adhesion of the image-protecting layer 13 to printed matter.

The base film 11 is provided with a heat-resistant slip layer 15 on a second surface S2 thereof opposite the first surface to facilitate the slipping of the base film 11. The heat-resistant slip layer 15 prevents the thermal transfer head (not shown) of a thermal transfer image-forming apparatus (for example, thermal transfer printer) from sticking to or fusing with the base film 11. The heat-resistant slip layer 15 is not necessarily provided if the base film 11 is sufficiently heat-resistant or capable of slipping well.

An adhesion promoting layer or a primer layer 16 may be provided only when the base film 11 and the non-transferable release layer 12 do not sufficiently adhere to each other, The structure shown in FIG. 1 has the adhesive layer 14, the heat-resistant slip layer 15, and the adhesion promoting layer or primer layer 16.

The thermal transfer laminate film of an embodiment of the invention will now be described in detail.

The base of a generally used ink ribbon may be used as the base film 11 as it is. Alternatively, other materials may be used without particular limitation. The base film 11 can be made of a general plastic film, such as polyester, polyethylene or polypropylene film, or a super-engineering plastic film, such as a polyimide film.

In order to ensure adhesion to the non-transferable release layer 12, an adhesion promoting layer (or primer layer) 16 may be formed on the base film 11. The base film 11 is intended to support the coatings formed thereon and is desirably resistant to heat energy from the thermal transfer head. Accordingly, it is desirable that the base film 11 be appropriately selected in view of the heat resistance, mechanical strength, dimensional stability, availability, cost and so forth. The present invention is intended to thermally transfer an image-protecting layer 13 having a super glossy surface. Accordingly, the base film 11 desirably has a highly smooth surface.

If an adhesion promoting layer 16 is provided between the base film 11 and the non-transferable release layer 12, the adhesion promoting layer 16 is desirably formed to a uniform thickness. Before the base film 11 is drawn, an adhesion promoting layer 16 is formed to a thickness of several micrometers. Then, the base film 11 is biaxially drawn so that the adhesion promoting layer 16 can be formed into a thin layer having a uniform thickness of 1 μm or less.

The material of the adhesion promoting layer (or primer layer) 16 is appropriately selected according to the materials of the base film 11 and the non-transferable release layer 12. For example, the adhesion promoting layer 16 may be made of an urethane resin, an acrylic resin, a polyester resin, or the like.

The non-transferable release layer 12 is made of a rubber-elastic resin. The rubber-elastic resin may be a natural rubber or a synthetic rubber, and can be selected from groups specified in Japanese Industrial Standards (JIS) K 6397.

Rubber-elastic resins listed in JIS K 6397 are grouped into the "M" group composed of rubber polymers having a saturated carbon chain of the polymethylene type; the "O" group composed of rubbers having carbon and oxygen in the polymer chain; the "Q" group composed of rubbers having silicon and oxygen in the polymer chain; the "R" group having an unsaturated carbon chain; the "T" group composed of rubbers having carbon, oxygen and sulfur in the polymer chain; the "U" group composed of rubbers having carbon, oxygen and nitrogen in the polymer chain; and "Z" group composed of rubbers having phosphorus and nitrogen in the polymer chain. These will be described in detail below.

The "M" group composed of rubbers having a saturated chain of the polymethylene type include ACM: rubber-like copolymer of ethyl acrylate (or other acrylates) and a small amount of a monomer which facilitates vulcanization (usually known as acrylic rubber); AEM: rubber-like copolymers of ethyl acrylate (or other acrylates) and ethylene; ANM: rubber-like copolymer of ethyl acrylate (or other acrylates) and acrylonitrile; CM: chloropolyethylene; CSM: chlorosulfonylpolyethylene; EBM: rubber-like copolymer of ethylene and butene; EOM: rubber-like copolymer of ethylene and octene; EPDM: rubber-like copolymer of ethylene, propylene and a diene; EPM: rubber-like copolymer of ethylene and propylene; EVM: rubber-like copolymer of ethylene and vinyl acetate; FEPM: rubber-like copolymer of tetrafluoroethylene and propylene; FFKM: rubber-like copolymer in which all substituent groups on the polymer chain are fluoro, perfluoroalkyl or perfluoroalkoxy groups; FKM: rubber-like copolymer having substituent fluoro, perfluoroalkyl or perfluoroalkoxy groups; IM: polyisobutene; NBM: rubber-like copolymer of fully hydrogenated acrylonitrile and butadiene (see HNBR in the "R" group); SEBM: rubber-like copolymer of styrene, ethylene and butene; and SEPM: rubber-like copolymer of styrene, ethylene and propylene.

The "O" group composed of rubbers having carbon and oxygen in the polymer chain include: CO: polychloromethyloxirane (usually known as epichlorohydrin rubber); ECO: rubber-like copolymer of ethylene oxide and epichlorohydrin; GCO: rubber-like copolymer of epichlorohydrin and allyl glycidyl ether; GECO: rubber-like copolymer of ethylene oxide, epichlorohydrin and allyl glycidyl ether; and GPO: rubber-like copolymer of propylene oxide and allyl glycidyl ether.

The Q" group composed of rubbers having silicon and oxygen in the polymer chain include FMQ: silicone rubber having methyl and fluorine substituent groups on the polymer chain; FVMQ: silicone rubber having methyl, vinyl and fluorine substituent groups on the polymer chain; MQ: silicone rubber having methyl substituent groups on the polymer chain, such as dimethyl polysiloxane; PMQ: silicone rubber having methyl and phenyl substituent groups on the polymer chain; PVMQ: silicone rubber having methyl, vinyl and phenyl substituent groups on the polymer chain; and VMQ: silicone rubber having methyl and vinyl substituent groups on the polymer chain.

The "R" group composed of rubbers having an unsaturated carbon chain include ABR: acrylate-butadiene rubber; BR: butadiene rubber; CR: chloroprene rubber; ENR: epoxidized natural rubber; HNBR: rubber-like copolymer of hydrogenated acrylonitrile and butadiene (some unsaturation remains, see NBR in the "M" group); IIR: rubber-like copolymer of isobutene and isoprene, such as butyl rubber; IR: isoprene rubber, such as synthetic natural rubber; MSBR: rubber-like copolymer of α-methylstyrene and butadiene; NBIR: rubber-like copolymer of acrylonitrile, butadiene and isoprene; NBR: rubber-like copolymer of acrylonitrile and butadiene, such as nitrile rubber; NIR: rubber-like copolymer of acrylonitrile and isoprene; NR: natural rubber; NOR: norbornene rubber; PBR: rubber-like copolymer of vinylpyridine and butadiene; PSBR: rubber-like copolymer of vinylpyridine, styrene and butadiene; SBR: rubber-like copolymer of styrene and butadiene; E-SBR: rubber-like copolymer of styrene synthesized by emulsion polymerization and butadiene; S-SBR: rubber-like copolymer of styrene synthesized by solution polymerization and butadiene; SIBR: rubber-like copolymer of styrene, isoprene and butadiene; XBR: carboxylated butadiene rubber; XCR: carboxylated chloroprene rubber; XNBR: rubber-like copolymer of carboxylated acrylonitrile and butadiene; XSBR: rubber-like copolymer of carboxylated styrene and butadiene; BIIR: rubber-like copolymer of brominates isobutene and isoprene, such as bromobutyl rubber; and CIIR: rubber-like copolymer of chlorinated isobutene and isoprene, such as chlorobutyl rubber.

The "T" group composed of rubbers having carbon, oxygen and sulfur in the polymer chain include OT: rubber having either a —$CH_2$—$CH_2$—O—$CH_2$—O—$CH_2$—$CH_2$— group or an R group, where R is an aliphatic hydrocarbon, not usually —$CH_2$—$CH_2$— group, between the polysulfide linkages in the polymer chain; and EOT: rubber having a —$CH_2$—$CH_2$—O—$CH_2$—O—$CH_2$—$CH_2$— group and usually —$CH_2$—$CH_2$— group but occasionally other aliphatic groups between the polysulfide linkages in the polymer chain.

The "U" group composed of rubbers having carbon, oxygen and nitrogen in the polymer chain include AFMU: rubber-like copolymer of tetrafluoroethylene, trifluoronitrosomethane and nitrosoperfluorobutyric acid; AU: polyester urethane; and EU: polyether urethane.

The "Z" group composed of rubbers having phosphorus and nitrogen in the polymer chain include FZ: rubber having a —P═N— chain and having fluoroalkoxy groups attached to the phosphorus atoms in the chain; and PZ: rubber having a —P═N— chain and having allyloxy (phenoxy and substituted phenoxy) groups attached to the phosphorus atoms in the chain.

The image-protecting layer 13 formed on the surface of the non-transferable release layer 12 is transferred onto the surface of a printed matter (not shown) by the thermal energy of the thermal transfer head (not shown). Hence, the image-protecting layer 13 will act as the uppermost thermoplastic resin layer of the printed matter. The image-protecting layer 13 may be made of polystyrene, acrylic or polyester resin. These resins can give a rubfastness, a chemical resistance, a solvent resistance or the like to the printed matter. Also, by adding a UV light adsorbent to the image-protecting layer, the lightfastness can be enhanced. Usable ultraviolet light adsorbents include salicylic derivatives, benzophenone derivatives, benzotriazole derivatives, and oxalic anilide derivatives.

The adhesive layer 14 formed on the surface of the image-protecting layer 13 may be made of thermoplastic resin, such as polyesters, celluloses, vinyl chloride-vinyl acetate copolymers, urethanes, ethylene-vinyl acetate copolymers, and styrene-acrylic copolymers. In order to enhance the adhesion with the printed matter, the adhesive layer desirably has a relatively low glass transition temperature, and preferably the glass transition temperature is about 40 to 100° C. In addition, it is desirably confirmed that the adhesive layer is superior in image storability, such as heat resistance, lightfastness, and dark place storability.

The non-transferable release layer 12, the image-protecting layer 13 and the adhesive layer 14 can be formed on the base film 11 by the following method. For example, a coating liquid containing the material resin of each layer is applied by gravure coating, gravure reverse coating, roll coating or any other method, followed by drying. At this time, the coating of the non-transferable release layer 12 is preferably formed to a thickness of about 0.1 to 5 μm; the coating of the image-protecting layer 13 is preferably formed to a thickness of about 0.1 to 20 μm; and the coating of the adhesive layer 14 is preferably formed to a thickness of about 0.1 to 10 μm.

A heat-resistant slip layer 15 may be made of, for example, cellulose acetate, polyvinyl acetoacetal resin or polyvinyl butyral resin. It is desirable that the thermal transfer laminate film 10 be transported without sticking the base film 11 to or fusing the base film 11 with the thermal transfer head (not shown). Accordingly, the heat-resistant slip layer 15 is desirably made of a heat-resistant resin. Also, it is desirable that the friction coefficient between the heat-resistant slip layer 15 and the thermal transfer head be kept constant irrespective of heating or not heating. Accordingly, the heat-resistant slip layer 15 may contain a lubricant, such as silicone oil, wax, fatty acid ester or phosphoric ester, or an organic or inorganic filler. The heat-resistant slip layer 15 is not necessarily provided if the base film 11 is sufficiently heat-resistant or capable of slipping well.

Examples of the thermal transfer laminate film of the invention will now be described.

First, the base film 11 will be described. A polyester film was used as the base film 11. As an example of the polyester film, 4.5 μm thick K604E4.5W manufactured by Mitsubishi Chemical Polyester Film Corporation was used.

A coating of the non-transferable release layer 12 having the composition of any one of Examples 1 to 5 shown in Table 1 was formed on one surface, first surface S1, of the base film 11 so as to have a dried thickness of, for example, 1 μm. The coating was then dried, for example, by baking at 100° C. for 2 minutes, thus forming the non-transferable release layer 12 of a thermal transfer laminate film 10.

TABLE 1

| | Composition | Content (parts by weight) |
|---|---|---|
| Example 1 | Silicone resin (Produced by Shin-Etsu Chemical, KS-847T) | 100 |
| | Curing agent (Produced by Shin-Etsu Chemical, CAT-PL-50T) | 3 |
| | Toluene | 197 |
| Example 2 | Silicone resin (Produced by Shin-Etsu Chemical, KS-774) | 100 |
| | Curing agent (Produced by Shin-Etsu Chemical, CAT-PL-50T) | 3 |
| | Toluene | 197 |
| Example 3 | Silicone resin (Produced by Shin-Etsu Chemical, KS-3703) | 100 |
| | Curing agent (Produced by Shin-Etsu Chemical, CAT-PL-50T) | 3 |
| | Toluene | 197 |
| Example 4 | Ethylene-propylene rubber (Produced by JSR, EP24) | 7.5 |
| | Toluene | 92.5 |
| Example 5 | Styrene-butadiene rubber (Produced by Asahi Kasei, H-1051) | 10 |
| | Toluene | 90 |

Subsequently, a coating of an image-protecting layer having a composition shown in Table 2 was formed on each non-transferable release layer 12 of Examples 1 to 5 so as to have a dried thickness of, for example, 0.8 μm. The coating was then dried by baking at 120° C. for 1 minute, thus forming the image-protecting layer 13.

Subsequently, a coating of an adhesive layer having a composition shown in Table 2 was formed on the image-protecting layer 13 so as to have a dried thickness of, for example, 0.8 μm. The coating was then dried by baking at 120° C. for 13 minute, thus forming the image-protecting layer 14. Thus, thermal transfer laminate films 10 were completed, each having the non-transferable release layer 12, the image-protecting layer 13 and the adhesive layer 14 of any one of Examples 1 to 5 on the first surface side of the base film 11.

Comparative Examples of the thermal transfer laminate film will now be described.

First, the thermal transfer laminate film of Comparative Example 1 will be described.

A polyester film was used as the base film 11. As an example of the polyester film, 4.5 μm thick K604E4.5W manufactured by Mitsubishi Chemical Polyester Film Corporation was used.

An image-protecting layer having the composition shown in Table 2 was formed on one side of the base film, and an adhesive layer having the composition shown in Table 2 was further formed on the image-protecting layer. Thus, a thermal transfer laminate film of Comparative Example 1 was completed. A heat-resistant slip layer was formed on the other side of the base film, opposite to the image-protecting layer.

TABLE 2

| | Composition | Content (parts by weight) |
|---|---|---|
| Image-protecting layer | MMA/n-BMA copolymer (LP62/03) | 10 |
| | Methyl ethyl ketone | 90 |
| Adhesive layer | Styrene-acrylic copolymer (Polysol AT 2011) | 10 |
| | Methyl ethyl ketone | 45 |
| | Toluene | 45 |

The thermal transfer laminate film of Comparative Example 2 will be described.

A polyester film was used as the base film 11. As an example of the polyester film, 4.5 μm thick K604E4.5W manufactured by Mitsubishi Chemical Polyester Film Corporation was used.

The coating of a non-transferable release layer having the composition of Comparative Example 2 shown in Table 3 was formed on one surface, first surface S1, of the base film 11 so as to have a dried thickness of 1 μm. The coating was then dried by baking at 100° C. for 2 minutes, thus forming the non-transferable release layer of a thermal transfer laminate film.

Subsequently, the coating of an image-protecting layer having the composition shown in Table 2 was formed on the non-transferable release layer so as to have a dried thickness of 0.8 μm. The coating was then dried by baking at 120° C. for 1 minute, thus forming the image-protecting layer.

Subsequently, the coating of an adhesive layer having the composition shown in Table 2 was formed on the image-protecting layer so as to have a dried thickness of 0.8 μm. The coating was then dried by baking at 100° C. for 1 minute. Thus, a thermal transfer laminate film of Comparative Example 2 was completed, having the non-transferable release layer, the image-protecting layer and the adhesive layer on the base film.

TABLE 3

| | Composition | Content (parts by weight) |
|---|---|---|
| Comparative Example 2 | Polystyrene resin (Produced by Toyo Styrene, G32) | 10 |
| | Toluene | 90 |

Each of the image-protecting layers of the thermal transfer laminate films of Examples 1 to 5 and Comparative Examples 1 and 2 was thermally transferred.

As a result, in the thermal transfer laminate films having rubber-elastic transferable release layers of Examples 1 to 5, the deformation of the base film caused by the thermal energy of the thermal transfer head did not affect the image-protecting layer. Consequently, the image-protecting layers transferred from the thermal transfer laminate films of Examples 1 to 5 had surfaces having improved 20° gloss and three-dimensional surface roughness profile in comparison with those of Comparative Examples.

The 20° gloss is a value of glossiness measured according to the 20° specular gloss measurement specified in JIS Z 8741 Specular glossiness-Methods of measurement.

More specifically, white ink was printed over the surface of photographic paper specified for a printer UP-DR 150 manufactured by Sony by the printer UP-DR150 using the thermal transfer laminate films of Examples 1 to 5 and Comparative Examples 1 and 2. The 20° gloss and the three-dimensional surface roughness profile of the resulting printed matter were measured, and the effect of the rubber-elastic non-transferable release layer of the Examples was evaluated.

The results of 20° gloss measurement are shown in Table 4.

TABLE 4

| | 20° gloss | Evaluation of glossiness |
|---|---|---|
| Example 1 | 74 | Excellent |
| Example 2 | 72 | Good |
| Example 3 | 75 | Excellent |
| Example 4 | 69 | Good |
| Example 5 | 70 | Good |
| Comparative Example 1 | 53 | Poor |
| Comparative Example 2 | 52 | Poor |

As shown in Table 4, the 20° glosses of Examples 1 to 5 were at least about 30% increased with respect to those in Comparative Examples 1 and 2, and the glossiness of the Examples was highly evaluated. When the non-transferable release layer 12 was made of silicone resin, ethylene-propylene rubber or styrene-butadiene rubber, the transferred image-protecting layer 13 exhibited a high 20° gloss. When the non-transferable release layer 12 was made of silicone resin, the transferred image-protecting layer 13 exhibited a particularly high 20° gloss.

Figure 2A:
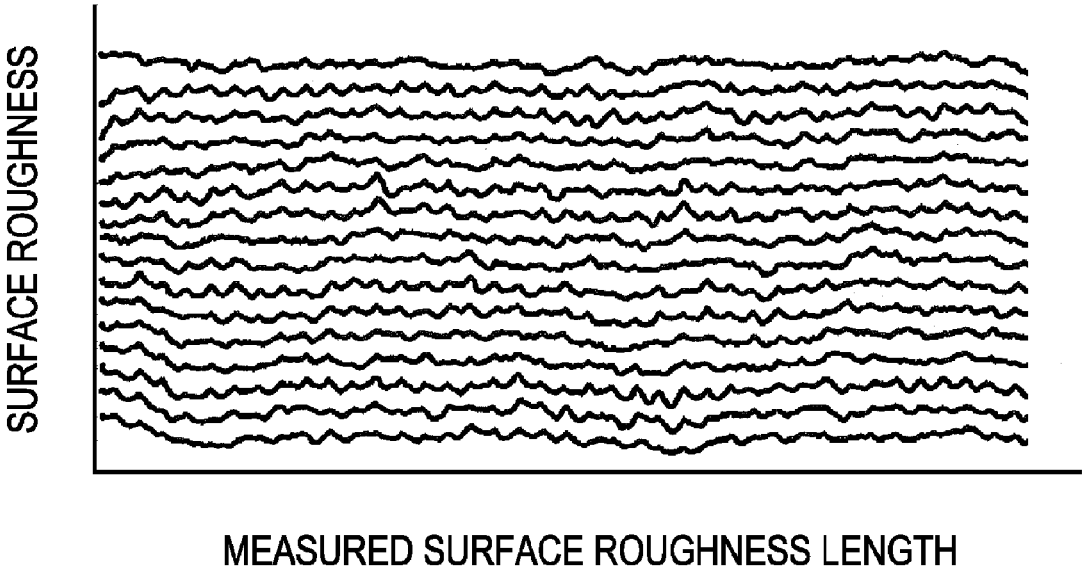
FIGS. 2A and 2B are the profiles of three-dimensional surface roughnesses of Example 1 and Comparative Example 2, respectively.
Figure 2B:
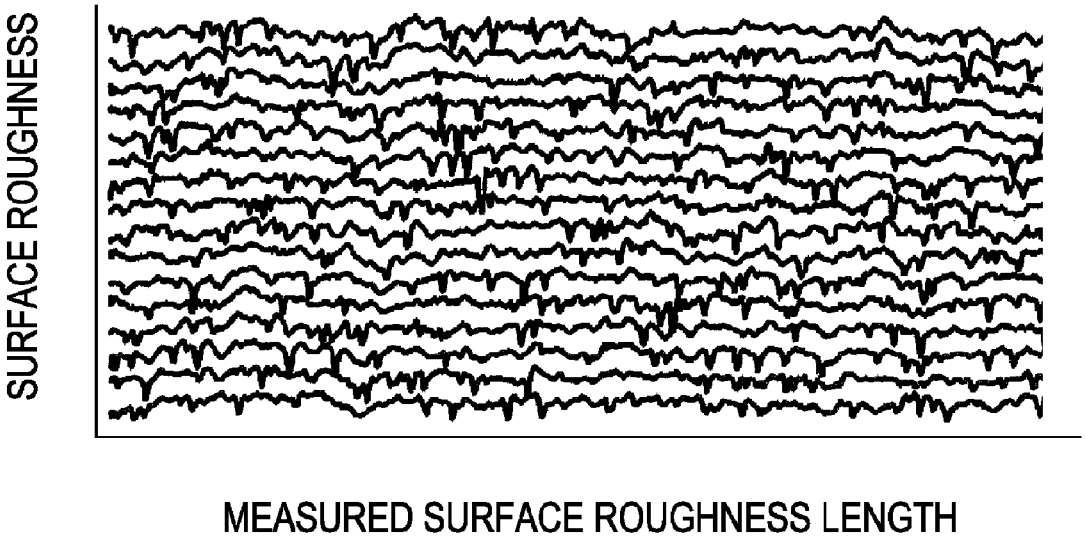

For a reference, FIGS. 2A and 2B show the measurement results of the three-dimensional surface roughnesses of Example 1 and Comparative Example 2, respectively.

FIG. 2A shows a profile of the surface roughness of the image-protecting layer transferred from the thermal transfer laminate film including the non-transferable release layer of Example 1. FIG. 2B shows a profile of the surface roughness of the image-protecting layer transferred from the thermal transfer laminate film including the non-transferable release layer of Comparative Example 2. FIGS. 2A and 2B were prepared on the same scale. The vertical axis represents surface roughness measured at regular intervals, and the lateral axis represents the measured surface roughness length.

FIG. 2 shows that the printed matter of Example 1 has smoother surface than that of Comparative Example 2. These results suggest that the rubber-elastic non-transferable release layer disposed between the base film and the image-protecting layer reduces the influence of the base film to maintain a smoothness at the interface between the non-transferable release layer and the image-protecting layer.

The image-protecting layer of the thermal transfer laminate film is transferred in the same manner as image data by thermal energy of the thermal transfer head. If the thermal transfer laminate film is formed as part of a thermal transfer sheet (generally referred to as ink ribbon) having an ink layer thereon, the ink image and the image-protecting layer (laminate film) can be thermally transferred continuously.

In the thermal transfer laminate film 10, the base film 11 is thermally deformed (shrunk) to have a rough surface after the thermal transfer head (not shown) is scanned with being pressed on a second surface S2 of the base film 11 opposite the first surface S1. The roughness resulting from the deformation of the base film 11 spreads toward the opposite side, or the first surface S1 (the image-protecting layer side), from the surface (second surface S2) on which the thermal transfer head has been pressed. Since the non-transferable release layer 12 is made of a rubber-elastic resin, however, the deformation of the base film 11 is absorbed at the surface on the base film side of the non-transferable release layer 12, and does not spread to the surface on the image-protecting layer side of the non-transferable release layer 12.

A rubber-elastic material is a highly viscous liquid in a sense. Accordingly, a small deformation as in the base film 11 (by, for example, pressure or heat) is absorbed at the surface of the rubber-elastic material. Then, on removing the external force of the base film 11, the original form of the rubber-elastic material is momentarily recovered.

Since the non-transferable release layer 12 is made of a rubber-elastic resin, the deformation of the non-transferable release layer side of the base film 11 is absorbed by elastic deformation of the surface on the base film side of the non-transferable release layer 12, and does not spread to the image-protecting layer side of the non-transferable release layer 12. Thus, the surface on the image-protecting layer side of the non-transferable release layer 12 is kept smooth.

A stress is produced at the interface between the non-transferable release layer 12 and the image-protecting layer 13 by the thermal transfer head. This stress acts so as to make the interface smooth. Thus, the surface of the non-transferable release layer 12 is made smooth by the rubber-elastic deformation.

The resulting smooth interface of the non-transferable release layer 12 with the image-protecting layer 13 is transferred to the surface of the image-protecting layer 13. In other words, the non-transferable release layer 12 and the image-protecting layer 13 flow along the smooth interface of the non-transferable release layer 12.

In this instance, when the image-protecting layer 13 is peeled at the interface between the non-transferable release layer 12 and the image-protecting layer 13, a pressure caused by the elasticity is gradually reduced as the interface comes close to the separation point. Thus, the image-protecting layer 13 can be peeled (the adhesion can easily be reduced) without receiving an undesirable force in the steps of cooling and peeling the image-protecting layer 13. Accordingly, the surface of the image-protecting layer 13 does not become rough after transfer.

Thus, even if the base film 11 is thermally deformed (shrunk) after scanning with the thermal transfer head pressed on the base film 11, the peeled surface of the image-protecting layer 13 is kept smooth.

Hence, the surface of the image-protecting layer 13 transferred onto printed matter has glossiness as high as silver halide photographs have without applying secondary treatment, and the resulting printed matter has a glossiness and surface smoothness appealing to the sensibility of the user.

Figure 3A:
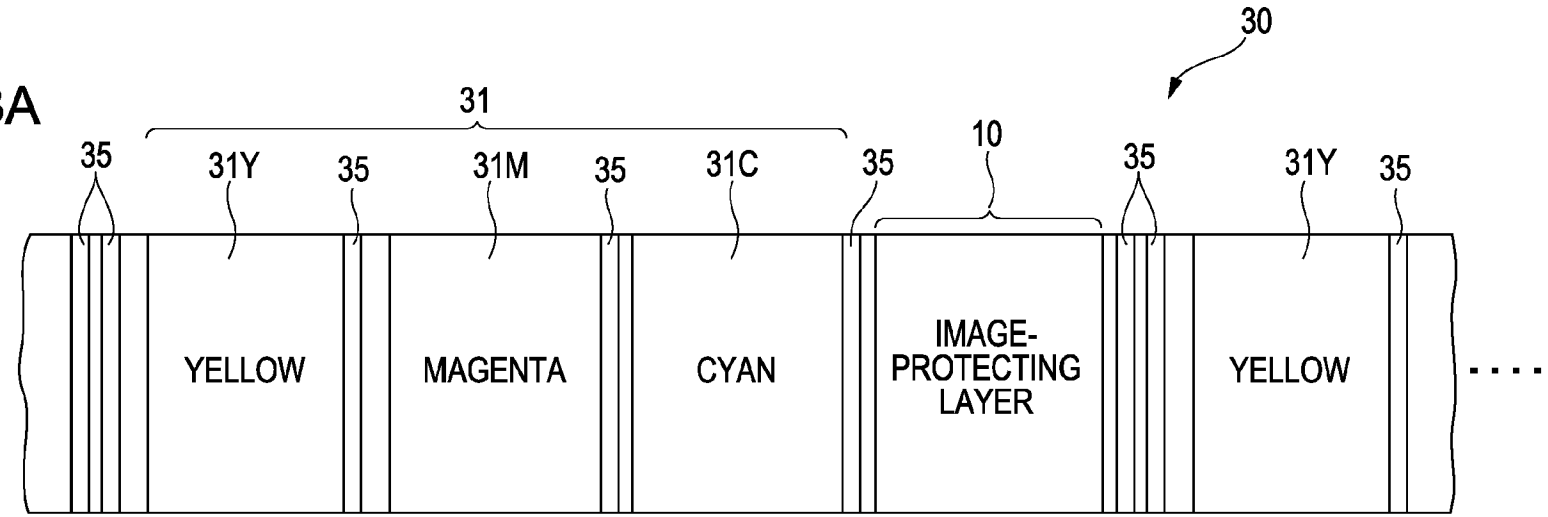
FIGS. 3A and 3B are a schematic plan view and a schematic sectional view of a thermal transfer sheet according to an embodiment of the invention.

A thermal transfer sheet according to an embodiment of the invention will now be described with reference to schematic views shown in FIGS. 3A and 3B. FIG. 3A is a schematic plan view and FIG. 3B is its schematic sectional view.

Figure 3B:
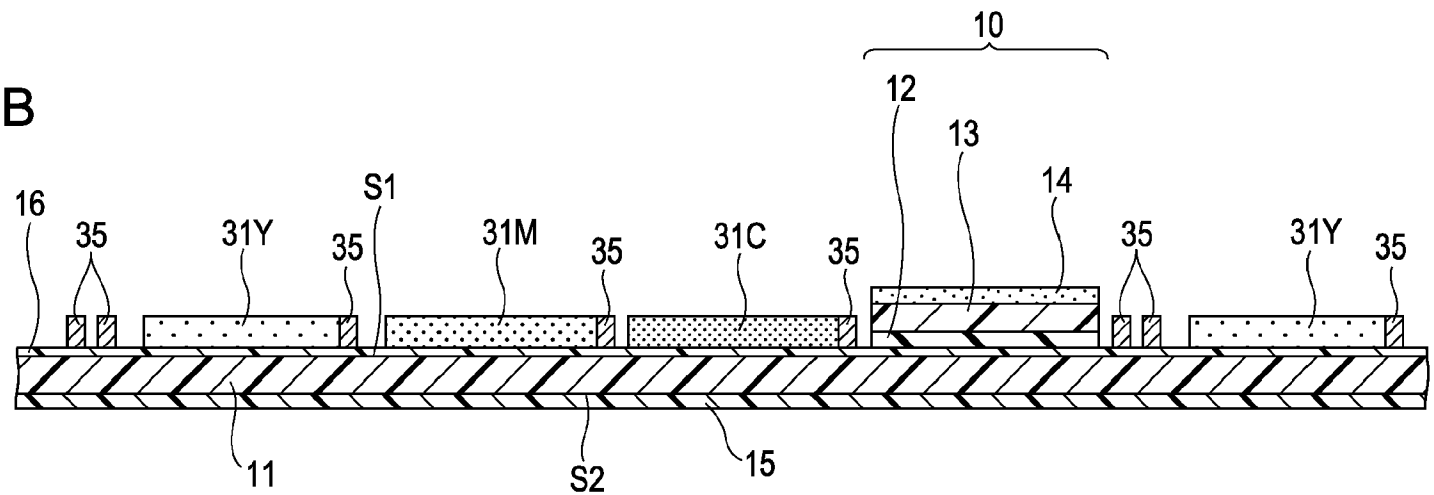

As shown in FIGS. 3A and 3B, the thermal transfer sheet 30 includes ink layers 31 (31Y, 31M and 31C) of yellow (Y), magenta (M) and cyan (C) on a first surface S1 side of a base film 11 with an adhesion promoting layer 16 therebetween, along the transporting direction thereof. In addition, a thermal transfer laminate film 10 according to an embodiment of the invention is formed in and on a part of the base film 11. More specifically, a non-transferable release layer 12 is formed on the base film 11 with the adhesion promoting layer 16 therebetween, and a transparent image-protecting layer 13 is formed on the non-transferable release layer 12. The image-protecting layer 13 has an adhesive layer 14 for enhancing the adhesion to printed matter.

The ink layers 31Y, 31M and 31C and the thermal transfer laminate films 10 are periodically arranged. The ink layers 31 are each made of, for example, a sublimation dye.

The thermal transfer laminate film 10 is disposed continuing from the ink layers 31Y, 31M and 31C.

In the thermal transfer sheet 30, sensor marks 35 are provided on one ends of ink layers 31 and near the thermal transfer laminate films 10.

Also, a heat-resistant slip layer 15 is disposed on the rear surface (second surface S2) of the base film 11. The heat-resistant slip layer 15 reduces the friction between the thermal transfer head and the ink ribbon and, thus, helps transport the ink ribbon stably.

The ink layers 31 may contain a binder resin. Exemplary binder resins include cellulose resins, such as methyl cellulose, ethyl cellulose, ethylhydroxyethyl cellulose, hydroxypropyl cellulose, cellulose acetate butyrate and cellulose acetate; vinyl resins, such as polyvinyl alcohol, polyvinyl butyral, polyvinyl acetoacetal, polyvinyl acetate and polystyrene; polyester resins; acrylic resins; and urethane resins.

The coloring dye in each ink layer 31 is dispersed or dissolved in the binder resin.

The coloring dye is often a mixture of several types and is thermally transferable.

The molecules of the coloring dye can thermally diffuse from the ink layer. Any dye used for the thermal transfer method in the past can be used as the coloring dye without particular limitation. Preferred yellow dyes include azo, disazo, methine, styryl and pyridine azo dyes and mixtures of these dyes. Magenta dyes include azo, anthraquinone, styryl and heterocyclic azo dyes and mixtures of these dyes. Cyan dyes include anthraquinone, naphthoquinone, heterocyclic azo and indoaniline dyes and mixtures of these dyes. Desirably, these dyes easily sublimate and thermally diffuse at an energy in the range of the heat energy of the thermal transfer head. Also desirably, these dyes are not thermally decomposed by an energy in the range of the heat energy of the thermal transfer head, can be easily synthesized, have superior image stability (stable to heat, light, temperature and chemicals), have appropriate absorption wavelength bands, and are difficult to recrystallize in the ink layer.

In thermal transfer printing performed by an image-forming apparatus (for example, thermal transfer printer) using the thermal transfer sheet 30, the image-protecting layer 13 and the adhesive layer 14 of the thermal transfer laminate film 10 are thermally transferred onto ink images by the thermal transfer head of the printer, thereby producing printed matter. More specifically, the ink layers 31 of the thermal transfer sheet 30 are thermally transferred to form images, and then the non-transferable release layer 12 and the image-protecting layer 13 of the thermal transfer laminate film 10 formed in and on part of the thermal transfer sheet 30 are separated at their interface. Thus, the image-protecting layer 13 and its overlying adhesive layer 14 are thermally transferred onto the ink images.

In the thermal transfer sheet 30, even if the base film 11 is thermally deformed (shrunk) to have a rough surface after the thermal transfer head scans with being pressed on the second surface S2 of the base film 11, the roughness of the surface is absorbed by the surface (on the base film side) of the non-transferable release layer 12 on the first surface S1 of the base film 11. The roughness caused by the deformation (for example, by pressure or heat) of the base film 11 does not affect the surface of the image-protecting layer side of the non-transferable release layer 12.

Since the non-transferable release layer 12 is made of a rubber-elastic resin, the deformation of the non-transferable release layer side of the base film 11 is absorbed by rubber-elastic deformation of the surface on the base film side of the non-transferable release layer 12, and does not spread to the image-protecting layer side. Thus, even if the base film 11 is thermally deformed (shrunk) to have a rough surface after scanning with the thermal transfer head pressed on the base film 11, the peeled surface of the image-protecting layer 13 is kept smooth.

Hence, the surface of the image-protecting layer 13 transferred onto printed matter has glossiness as high as silver halide photographs have without applying secondary treatment, and the resulting printed matter has a glossiness and surface smoothness appealing to the sensibility of the user.

An image-forming apparatus according to an embodiment of the present invention will now be described with reference to the schematic representation of the principal printing part of the image-forming apparatus shown in FIG. 4.

Figure 4:
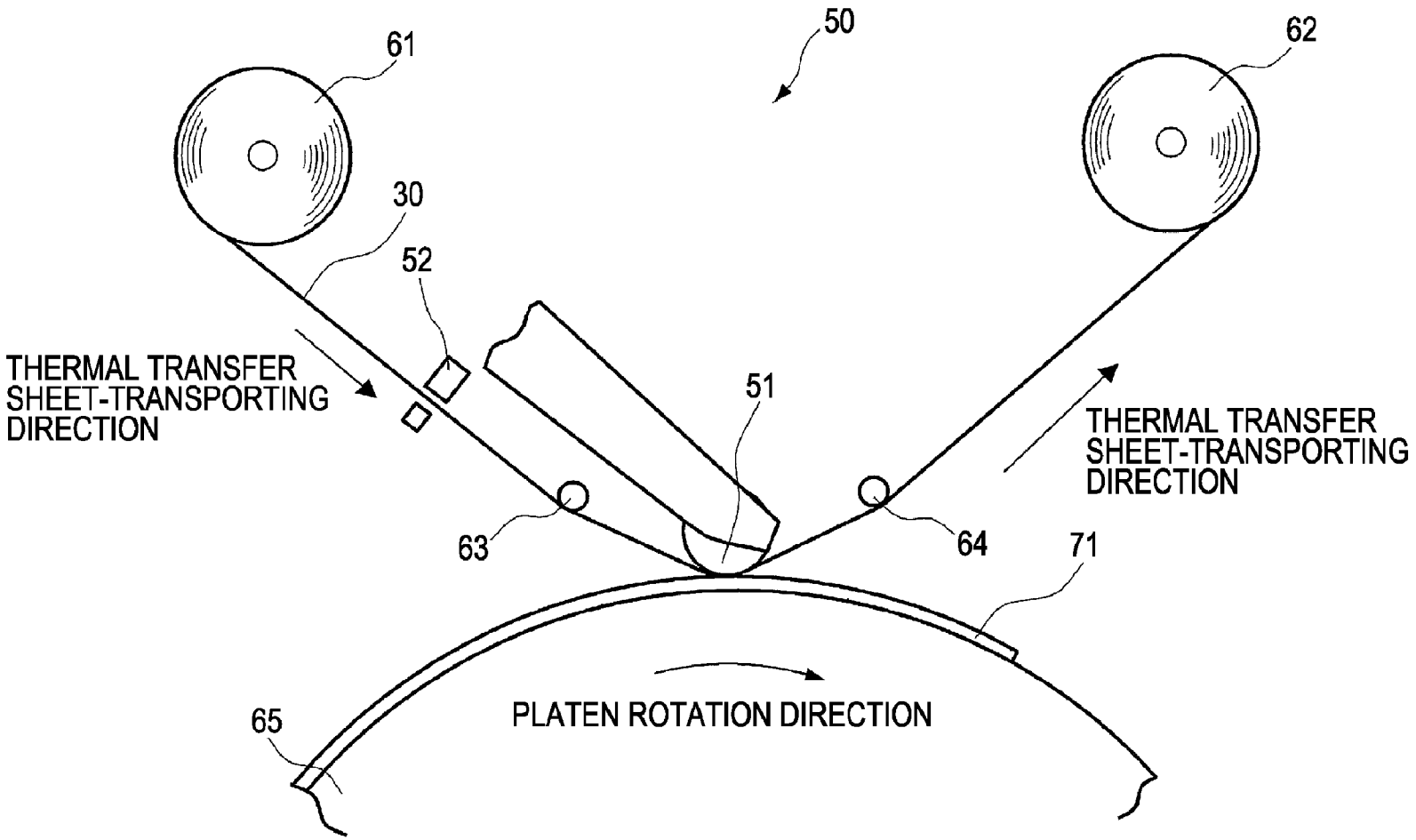
FIG. 4 is a fragmentary representation of principal components of an image-forming apparatus according to an embodiment of the invention.

The principal printing part include a supply reel 61 as transporting means for supplying the thermal transfer sheet (usually referred to as ink ribbon) and a take-up reel 62 for taking up the thermal transfer sheet 30, as shown in FIG. 4. In addition, guide rollers 63 and 64 are provided to guide the thermal transfer sheet 30 to a printing position. A thermal transfer head 51 defining the printing position is disposed between the rollers 63 and 64.

In order to transport a recording medium or image-receiving sheet 71 to the printing position corresponding to the thermal transfer head 51, a platen 65 is disposed as transporting means. The image-receiving sheet 71 is transported by the rotation of the platen 65. The image-receiving sheet 71 is a sheet on which printing can be performed, and may be, for example, photographic paper.

The principal part will be described in detail below.

The thermal transfer sheet 30 wound around the supply reel 61 is taken up by the take-up reel 62 driven by a driving motor (not shown) with being supported by the guide rollers 63 and 64.

The supply reel 61 has, for example, a torque limiter (not shown) to apply back tension to the thermal transfer sheet 30 at a constant torque.

The take-up reel 62 has, for example, a take-up detection encoder including an optical sensor.

Yellow, magenta and cyan dyes are each applied in one page amount to a predetermined length on the thermal transfer sheet 30.

The thermal transfer sheet 30 has a page head mark and a winding diameter mark at the head position of each of one page amounts of color dyes, and a color identification mark at the head position of each color dye. These marks correspond to the above-mentioned sensor marks 35 (see FIGS. 3A and 3B).

In the image-forming apparatus 50, an optical sensor 52 disposed in the transport passage of the thermal transfer sheet 30 detects the page head marks and color identification marks, and the head of each dye of the thermal transfer sheet 30 is determined according to the detection results.

A head unit (not shown) having the thermal transfer head 51 is removably secured to one end of a pressure lever rotatably held on a rotation shaft. The other end of the pressure lever is secured to a cam plate with a ring therebetween for swinging movement. Thus, the head unit is vertically moved by rotation of the cam plate driven by the head driving motor, and is located at a position within the vertical movement, at an initial separation position where the head unit moves up to separate from the ribbon, or at the lowermost position where the head unit moves down to come into contact with the image-receiving sheet 71.

Thus, the head unit is moved to the initial position for loading the thermal transfer sheet 30, and is moved to the lowermost position when the image-receiving sheet 71 is placed on the platen 65.

The vertical movement of the head unit is detected by a photo sensor disposed, for example, close to a notch of the cam plate. The thermal transfer head 51 is of edge type, and comes into contact with the entire width of the image-receiving sheet 71 with the thermal transfer sheet 30 therebetween.

Thus, an image is printed over the enter surface of the image-receiving sheet 71 by transporting the image-receiving sheet 71 in the direction indicated by the arrows.

The image-forming apparatus 50 including the above-described components prints images on the image-receiving sheet 71 to produce printed matter.

A method for forming an image on photographic paper will now be described.

The thermal transfer sheet 30 used in the image-forming apparatus 50 has an periodical arrangement of yellow ink layers 31Y, magenta ink layers 31M, cyan ink layers 31C and image-protecting layers 13 from the take-up side (take-up reel 62) to the supply side (supply reel 61), for example, as shown in FIGS. 3A and 3B.

Yellow, magenta and cyan component images are thermally transferred by sublimation onto the image-receiving layer (printing surface) formed at the surface of the image-receiving sheet 71, and subsequently the image-protecting layer 13 is thermally transferred onto the entire printed surface by sublimation, in the image-forming apparatus 50.

In the image-forming apparatus 50, the formation of a laminate of the image-protecting layer 13 and the image formation from the other color layers are performed in the same printing step.

In the above-described color printing, an image-protecting layer 13 is formed on the printed image to enhance the lightfastness, sebum resistance and so forth. Accordingly, the resulting printed matter is prevented from fading, and thus its storability is enhanced.

The present application contains subject matter related to that disclosed in Japanese Priority Patent Application JP 2008-147953 filed in the Japan Patent Office on Jun. 5, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal transfer laminate film comprising:

a base film;

a non-transferable release layer made of a rubber-elastic resin and disposed on one side of the base film; and an image-protecting layer disposed on the non-transferable release layer.

2. The thermal transfer laminate film according to claim 1, wherein the rubber-elastic resin is a natural rubber or a synthetic rubber.

3. The thermal transfer laminate film according to claim 2, wherein the rubber-elastic resin of the non-transferable release layer is selected from the groups consisting of the rubber-elastic resins categorized into the M group, the R group and the Q group specified in Japanese Industrial Standards JIS K 6397.

4. The thermal transfer laminate film according to claim 3, wherein the non-transferable release layer is made of ethylene-propylene rubber, styrene-butadiene rubber or silicone rubber.

5. The thermal transfer laminate film according to claim 1, further comprising an adhesive layer on the image-protecting layer.

6. A thermal transfer sheet comprising:

a base film having a first surface on one side thereof;

a non-transferable release layer made of a rubber-elastic resin and disposed on the first surface side of the base film;

an image-protecting layer disposed on the non-transferable release layer; and an ink layer disposed on the first surface side of the base film, the ink layer being to be thermally transferred to form an image.

7. An image-forming apparatus comprising:

transporting means for transporting a recording medium in a predetermined direction;

a thermal transfer sheet including a base film, a non-transferable release layer made of a rubber-elastic resin and disposed on one side of the base film, an ink layer that is to be thermally transferred onto the surface of the recording medium, and an image-protecting layer that is disposed on the non-transferable release layer and is to be transferred to protect the image;

thermal transfer sheet-transporting means for transporting the thermal transfer sheet; and a thermal transfer head thermally transferring the ink layer or the image-protecting layer onto the surface of the recording medium.

8. An image-forming apparatus comprising:

a transporting member transporting a recording medium in a predetermined direction;

a thermal transfer sheet including a base film, a non-transferable release layer made of a rubber-elastic resin and disposed on one side of the base film, an ink layer that is to be thermally transferred onto the surface of the recording medium, and an image-protecting layer that is disposed on the non-transferable release layer and is to be transferred to protect the image;

thermal transfer sheet-transporting member transporting the thermal transfer sheet; and a thermal transfer head thermally transferring the ink layer or the image-protecting layer onto the surface of the recording medium.

* * * * *